United States Patent [19]

Baumstingl

[11] 4,045,943

[45] Sept. 6, 1977

[54] APPARATUS FOR PACKAGING STERILE PRODUCTS

[75] Inventor: Herbert Baumstingl, Tremelo, Austria

[73] Assignee: Papeteries de Belgique, Austria

[21] Appl. No.: 651,933

[22] Filed: Jan. 23, 1976

[51] Int. Cl.[2] ..... B65B 31/02; B65B 55/06; B65B 55/10

[52] U.S. Cl. ..... 53/112 A; 21/99; 53/167

[58] Field of Search ..... 53/22 A, 28, 180 M, 53/182 M, 167, 112 A; 21/53, 58, 93, 99

[56] References Cited

U.S. PATENT DOCUMENTS

| | | | |
|---|---|---|---|
| 2,918,770 | 12/1959 | Stocker | 53/180 M |
| 3,086,336 | 4/1963 | Rausing et al. | 53/180 M |
| 3,947,249 | 3/1976 | Egger | 53/167 X |

*Primary Examiner*—Robert Louis Spruill
*Attorney, Agent, or Firm*—Hill, Gross, Simpson, Van Santen, Steadman, Chiara & Simpson

[57] ABSTRACT

Apparatus for conditioning sterile liquid products in a continuous tubular pack comprises an enclosure containing means for sterilizing a web of material intended to form the pack, means in the enclosure for forming the web into a tube and means for filling the tube with a sterile liquid product. The enclosure is capable of resisting an internal pressure of hot water at 120° C of at least 3 kg/cm² and is provided with means for temporarily sealing an inlet slot through which the web can be fed into the enclosure, and an outlet slot through which the tube can leave the enclosure.

10 Claims, 3 Drawing Figures

APPARATUS FOR PACKAGING STERILE PRODUCTS

The present invention relates to apparatus for conditioning sterile liquid products in a continuous tubular pack, the apparatus comprising means for sterilizing a web of material intended to form a pack, means for longitudinally folding said strip to form a longitudinally open tube, means for longitudinally welding the tube, and a pipe for filling this tube with sterile liquid.

In known apparatus, the means for sterilizing the strip, for folding it longitudinally, for opening it up into a tube, for welding the tube longitudinally and for filling the welded tube with a sterile liquid are open to the air, so that they are exposed to an atmosphere containing microbes and therefore do not enable the sterile product to be conditioned without risk of infection, but only permit pasteurization to be carried out.

Furthermore, in the known apparatus, the pipe for filling the tube with sterile liquid and a valve controlling the flow of the sterile liquid have to be sterilized separately prior to each further use, thus requiring laborious removal and refitting of these parts.

The object of the present invention is to provide a novel installation for handling sterile products under sterile conditions. This novel installation enables the above-mentioned disadvantages of the known installations to be eliminated, and at the same time it is more economical than the installations previously known.

Accordingly the present invention provides apparatus for conditioning a sterile liquid product in a continuous tubular pack, said apparatus comprising at least one enclosure containing means for sterilizing a web of material intended to form the pack, inlet slot means in the enclosure through which said web can be fed into the interior of the enclosure, means in the enclosure for sterilizing the two faces of the web, means for longitudinally folding the web in the enclosure to form a longitudinally open tube, means in the enclosure for longitudinally welding the open tube to close the tube longitudinally, a pipe for filling said tube with the sterile liquid product, outlet slot means through which the filled tube can be discharged from the enclosure, and means for continuously passing a sterile gas into the enclosure, said enclosure being capable of resisting an internal pressure of hot water at 120° C of at least 3 kg/cm$^2$, being provided with removable gasket means for temporarily sealing the inlet and outlet slot means, and being provided with inlet and discharge means for said hot water for enabling the interior of the enclosure to be sterilized.

According to one preferred feature of the invention, the inlet means for hot water comprises said pipe for filling the tube with sterile liquid.

According to a further preferred feature, the pipe for filling the tube with sterile liquid is equipped with a valve which also serves to control the flow of the hot water admitted into the enclosure for the purpose of sterilizing it, and the flow of the sterile liquid introduced into the tube to fill it, this valve being sterilized by the passage there-through of the hot water.

According to yet another feature, the means for maintaining the enclosure in a sterile condition comprises means for continuously admitting a compressed sterile gas which escapes through the inlet slot through which the flexible web enters the enclosure, and through the outlet slot through which the tube leaves this enclosure.

Other features and details of the invention will be seen from the following description of the annexed drawings which illustrate diagrammatically and by way of example only one form of construction of an installation in accordance with the invention.

In these Figures identical components are designated by the same reference numerals.

Figure 1:
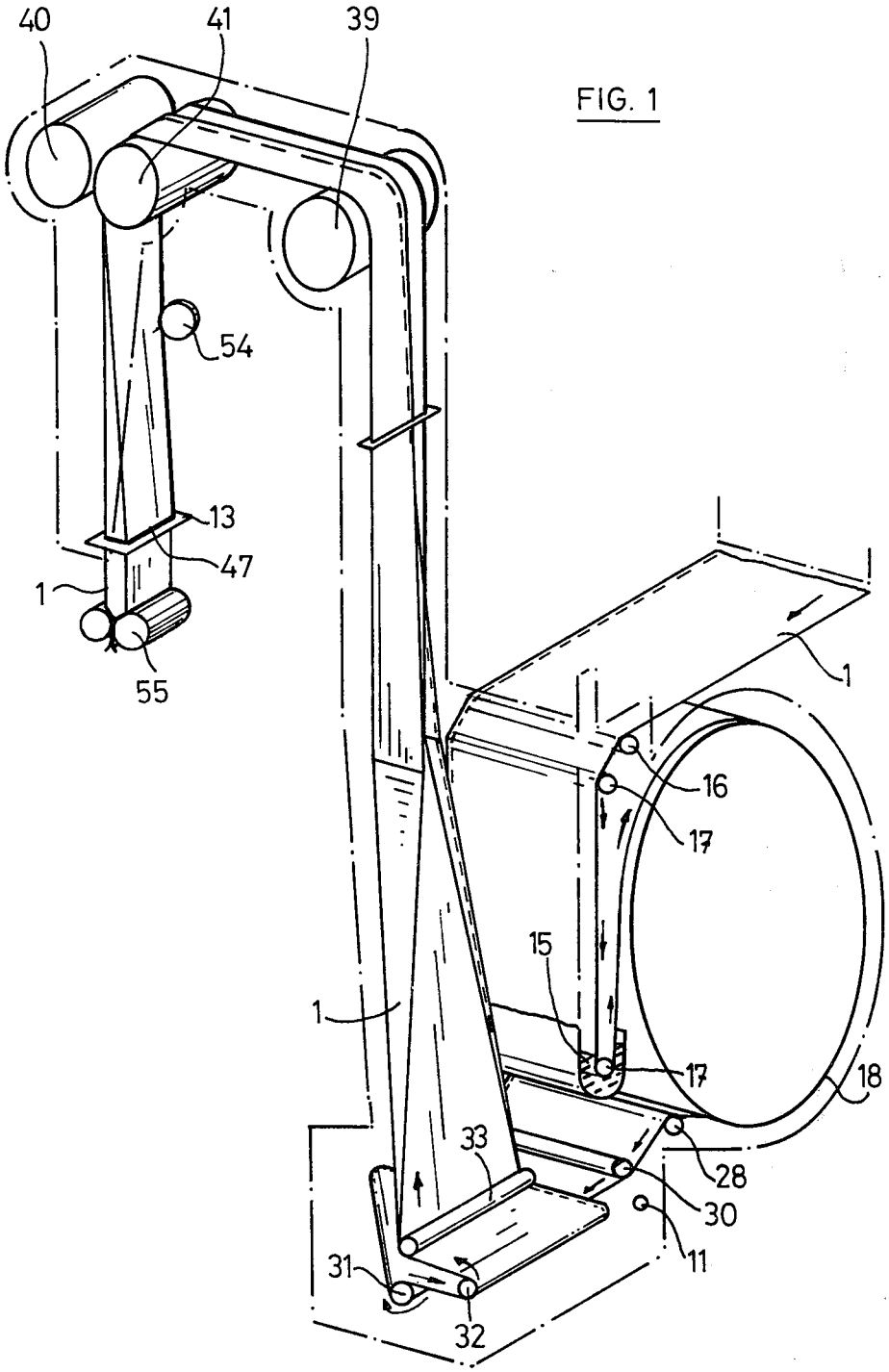
FIG. 1 is a diagrammatic perspective view of apparatus embodying the invention.
Figure 2:
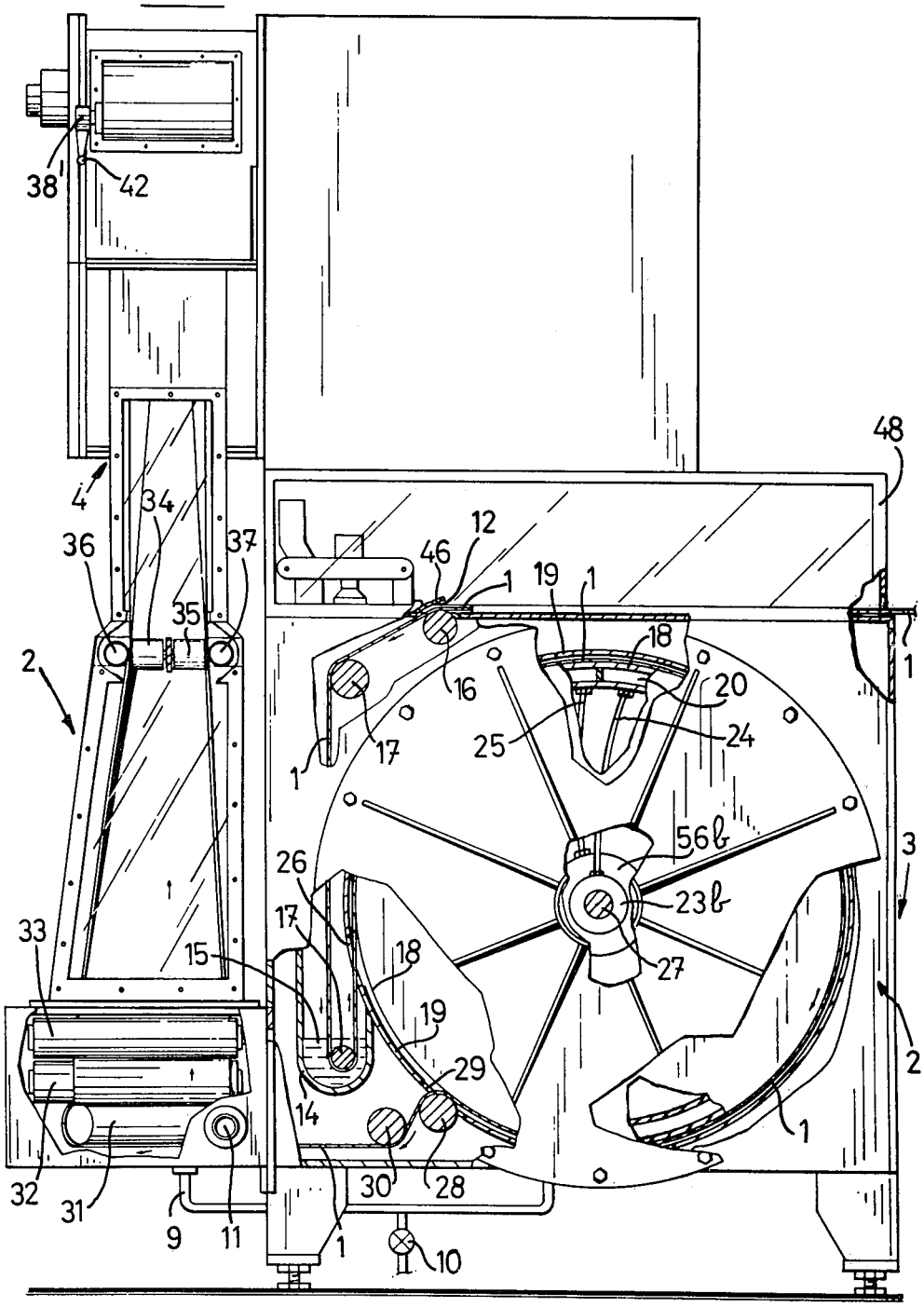
FIG. 2 is a partially fragmented side elevation of the apparatus shown in FIG. 1.
Figure 3:
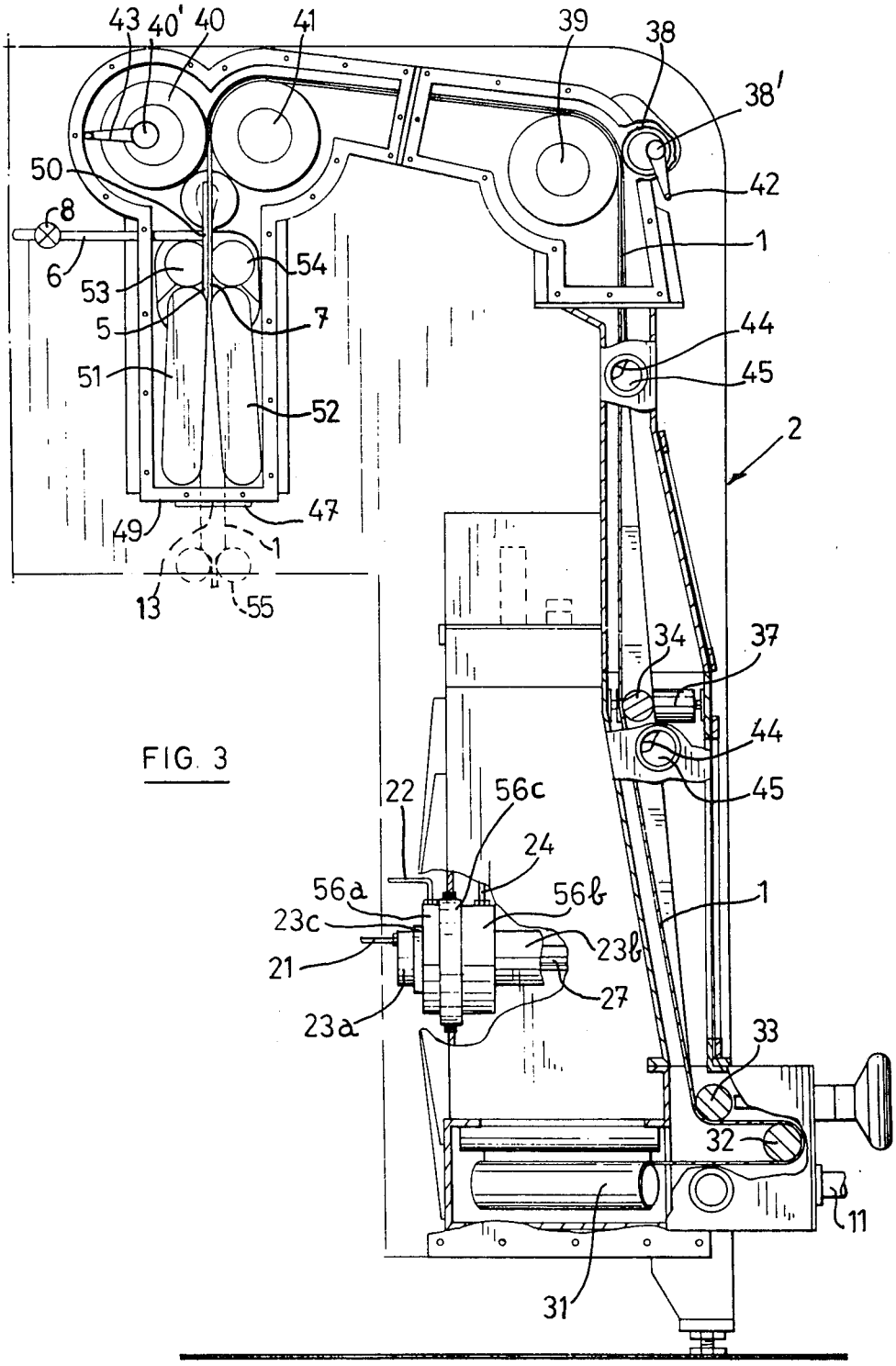
FIG. 3 is a partially fragmented front elevation of the apparatus shown in FIG. 2.

The illustrated apparatus is for producing sterile packs suitable for containing a sterile fluid, such as sterilized milk.

The packs are formed from a web 1 of flexible composite material including at least one layer of synthetic plastics material which can be hot pressure-welded and the web is provided in known manner with longitudinal and transverse fold lines or scoring.

A preferred composite material is constituted by several hot-laminated layers of material as follows:

- a first layer of polyethylene having a weight of 60 g/m$^2$ and forming the reverse face of the web,
- a first layer of aluminum foil having a thickness of 9$\mu$ or a weight of 25 g/m$^2$,
- a second layer of polyethylene having a weight of 20 g/m$^2$,
- a sheet of cardboard having a weight of 260 g/m$^2$, and
- a third layer of polyethylene having a weight of 15 g/m$^2$ and forming the front face of the web.

The apparatus shown comprises an enclosure 2 provided with means for closing it hermetically and for resisting an internal pressure higher than atmospheric pressure of at least 6 kg/cm$^2$. This enclosure 2 contains means 3 for sterilizing the flexible web 1, means 4 for folding the web longitudinally, means 5 for opening out the thus folded web to form a longitudinally open tube, a pipe 6 for filling this tube with sterile liquid, and means 7 for welding the tube longitudinally.

The enclosure 2 also includes means for admitting and discharging a sterilizing fluid - in this example water heated to a temperature of between 120° C and 150° C at a pressure of between 3 and 5 kg/cm$^2$.

The means for admitting the hot water comprises the pipe 6 which is also used for filling the tube with sterile liquid. This filling pipe 6 is provided with a valve 8. The valve 8 serves to control the flow of the sterilizing fluid admitted to the enclosure 2 for sterilizing the latter, and then to control the flow of sterile liquid introduced into and filling the tube 1. When the sterilizing liquid is introduced through the valve 8 and the pipe 6 for filling the tube, these components are at the same time sterilized without it being necessary to detach them from the installation.

At its base the enclosure has a duct 9 provided with a valve 10 for discharging the hot water after sterilization of the enclosure.

To maintain the enclosure in a sterile condition during the conditioning and forming operations on the web and to dry the enclosure, the enclosure is filled with a sterile gas through a pipe 11. This gas, which may be sterile air for example, is kept in a compressed condition in the enclosure while it is passed through an inlet port 12 (in the form of a slot), is fed along the flexible web within the enclosure and leaves the enclosure through an outlet 13 for the tube 1. The above-mentioned inlet port 12 for the web 1 and outlet 13 for the tube 1 are preferably of a size and shape that closely surround the cross-section of the web and of the filled tube respectively. The sterile gas, which is continuously discharged through the outlet, forms an aseptic barrier which prevents the entry of non-sterile air into the enclosure during the continuous travel of the web into the enclosure and during the continuous discharge of the filled tube therefrom.

The means for sterilizing the web 1 on its two faces comprise a stainless steel receptacle 14 containing a sterilizing bath 15, for example oxygenated water having an aqueous concentration of between 5% and 30%. This oxygenated water is kept at a temperature of between 40° and 60° C by means (not illustrated) for example a stainless steel electrical resistance element. Means, likewise not illustrated, are provided for supplying the receptacle with oxygenated water.

The web 1, introduced through the inlet slot 12, is passed over one or more parallel rollers 16 towards two direction-changing rollers 17 arranged parallel to one another and in the same vertical plane to guide the web vertically into the bath of heated oxygenated water and to ensure that vapor from the oxygenated water is directed on to the two faces of the web before and after its immersion in the bath. The apparatus for sterilizing the web also comprises means for heating the web after it has been immersed in the bath. These web heating means includes a substantially concentric rotatable drum 18 mounted to rotate freely on a shaft 27 within a closed casing 19 having inlet and outlet passages 26 and 29 respectively for the web 1. The drum 18 has an inner concentric wall 20 which delimits an annular space through which passes a heating fluid, for example circulated oil. This oil is heated to a temperature of between 90° and 95° C in a heating tank separate from the enclosure. For this purpose the inner wall 20 of the drum 18 is connected to the tank by an inlet pipe 21 and a discharge pipe 22 extending through two concentric hollow shafts 23 and 56 disposed around the central shaft 27 of the drum. These hollow shafts 23 and 56 are connected by two flexible pipes 24 and 25 to the annular space between the inner and outer walls of the drum. To establish connection between the hollow shafts 23 and 56 on the one hand and the pipes 24 and 25 respectively on the other, these shafts 23 and 56 each comprise a fixed part **23*a* and 56*a* respectively, mounted on the fixed casing of the drum, and a part 23*b* and 56*b* respectively each of which rotates with the drum, the moveable and fixed parts being connected to each other by sleeves 23*c* and 56*c***, provided with joints such as ring seals.

After having been immersed in the bath of oxygenated water, the web 1 is picked up by the exterior of the drum 18 through the inlet passage 26 and is held against the heated exterior of the drum 18 over an arc of at least 270 degrees by the roller 17 located in the bath, and by a pressure roller 28 arranged parallel to the roller 17.

After having been heated to achieve its sterilization, the web 1 leaves the drum 18, moves through the outlet passage 29 and is guided by a direction-changing roller 30 towards the means 4 for folding the web 1 longitudinally.

The pipe 11 for admitting sterile gas into the enclosure is advantageously located near the position where the web, having been moistened by the oxygenated water, passes to the outlet of the casing 19, so that the sterile gas mixes with the residual vapors from the oxygenated water and dries the web 1.

That portion of the enclosure that encloses the means 4 for longitudinally folding the web 1 is in the form of a sleeve or sheath which, at its bottom, communicates with the means 3 for sterilizing the web and, at its top, with that portion of the enclosure containing the means 5 for opening up the folded web 1. Further drying of the web 1 is carried out in this sheath under the action of the sterile air injected thereinto.

This sheath contains at its base three guide rollers 31, 32 and 33 for turning the web 1 through 90° from the direction in which it enters the sheath. For this purpose, the roller 31 is adjustably mounted at an angle of 45° to the roller 30 and the rollers 32 and 33 which pass the web 1 towards the folding means 4 which is disposed half-way up the sheath where the portions of the web 1 to be folded are turned through approximately 90°.

The folding means 4 comprises four rollers 34, 35, 36 and 37. The rollers 34 and 35 are arranged coaxially as an extension one of the other, at a distance apart corresponding to the unfolded portion of the web delimited by the fold lines previously provided on the web. The rollers 36 and 37 are arranged parallel to each other and at right-angles to the rollers 34 and 35 at the free end of the first rollers in the horizontal plane of the latter. The rollers 34 and 35 are spaced from each other by a distance corresponding substantially to the thickness of the vertically folded web 1 at this position.

The enclosure 2 also contains, at a point along the ascending portion of the web 1, a first pair of rollers 38 and 39, between which the portions of the web 1 to be folded are folded through an angle of approximately 180°. The roller 39 passes the folded strip between a second pair of drive rollers 40 and 41 mounted to the rear (downstream) of the previously mentioned pair 38 and 39 along a descending portion of the path of travel of the web 1 before the web 1 opened up. The rollers 38 and 40 are concentrically mounted on eccentrically mounted support shafts 38' and 40' respectively and are provided with manual operating levers 42 and 43 which are mounted on the shafts 38', 40' of the rollers 38 and 40 and which, when rotated, cause the rollers 38 and 40 to move towards the respective cooperating rollers 39 and 41 respectively so as to apply pressure to the web and to cause it to be advanced manually when it is brought into the enclosure.

The manual feeding of the web 1 into the enclosure 2 is further facilitated by a number of hermetically sealed gloves accessible from the exterior of the enclosure 2 and fitted in orifices 44 in the wall of the enclosure. These orifices 44 are provided with gaskets 45 which apply a counter-pressure while the enclosure is being pressurized, so that they prevent the gloves from being ejected outwards through these orifices 44 under the effect of the internal pressure obtaining in the enclosure 2. These gaskets 45 are constituted by discs which are removably secured to the wall of the enclosure 2.

Furthermore, the inlet slot 12 for admitting the web 1 to the enclosure 2, and the outlet 13 for enabling the filled tube to pass out of the enclosure 2 are likewise provided with disc gaskets 46 and 47 which are removably fitted on the walls 48 and 49 respectively of the enclosure 2 and which temporarily seal the enclosure while hot sterilizing fluid (water under pressure) is being passed into it.

The means 5 for opening up the web 1 to form a longitudinally open tube comprises a vertical separating plate 50 fixed in the enclosure on the bottom wall thereof below the second pair of rollers 40 and 41 disposed along the downward path of the folded web 1. When the web 1 is fitted in position in the enclosure 2, the folded portions of the web 1 are separated by hand using gloves and are placed one on each side of the plate 50. Then, when the web 1 advances, this plate 50 opens up the folded web 1 to form it into a longitudinally open tube. Two stainless steel belts 51 and 52, the tension of which is variable, which move in the feed direction of the endless tube and the spacing between which is regulatable, are disposed one on each side of the plate 50; these belts 51 and 52 diverge from each other in the downward direction and contain the opened-up walls of the tube while it is being filled with sterile liquid.

The means 7 for the longitudinal welding of the tube comprises two pressure rollers 53 and 54 which are located in the enclosure 2 along the descending portion of the web 1, to the rear of the plate 50 and of the filling pipe 8, between the pair of rollers 40 and 41 and the pair of belts 51 and 52. These pressure rollers 53 and 54 weld the longitudinal edges of the tube so as to close it in the longitudinal direction, and they seal in the sterile liquid which is introduced into the longitudinally closed portion of the tube.

In the customary manner, an apparatus 55 for transversely welding the tube and for cutting it up into separate packs is provided below the wall 49 of the enclosure 2, the packs undergoing finishing treatment in a following station.

Also provided is a sensor for controlling the level of the sterile liquid in the tube.

It is obvious that the invention is not exclusively limited to the installation described and illustrated, by way of example and that modifications can be made as regards the form, disposition and constitution of certain of the components used in carrying out the invention, without departing from the scope of the invention provided that these modifications fall within any of the following claims.

We claim:

1. Apparatus for conditioning a sterile liquid product in a continuous tubular pack, said apparatus comprising in a sole enclosure:

inlet slot means through which a web can be fed into the interior of the enclosure;

a receptacle containing a sterilizing bath and is provided with guides for the web in this bath and a heated rotatable drum contained in a casing concentric therewith, which drum is arranged to pick up the web from the sterilizing bath and heat the web on its inner and outer faces by direct contact and radiation respectively;

means for longitudinally folding the web to form a longitudinally open tube;

means for longitudinally welding the open tube to close the tube longitudinally;

a pipe for filling said tube with the sterile liquid product;

outlet slot means through which the filled tube can be discharged from the enclosure; and means for continuously passing a sterile gas into the enclosure, said enclosure being capable of resisting an internal pressure of hot water at 120° C of at least $3kg/cm_2$, being provided with removable gasket means for temporary sealing the inlet and outlet slot means, and being provided with inlet and discharge means for said hot water for enabling the interior of the enclosure to be sterilized.

2. Apparatus as claimed in claim 1, in which the inlet means for admitting hot water under pressure comprises said pipe for filling the tube with sterile liquid.

3. Apparatus as claimed in claim 2 in which the pipe for filling the tube with sterile liquid is provided with a valve which also serves to control the flow of hot water admitted into the enclosure for sterilizing the latter, and to control the flow of the sterile liquid introduced into the tube to fill it, said valve being sterilized by the passage therethrough of the hot water.

4. Apparatus as claimed in claim 1, in which the enclosure contains parallel rollers for pressing the strip against the drum over an arc of at least 270°.

5. Apparatus as claimed in claim 1, in which the means for admitting the sterile gas into the enclosure comprises a pipe near the point where the strip passes from the drum, so that the strip is dried by said sterile gas.

6. Apparatus as claimed in claim 1, including hermetically sealed gauntlets accessible from the exterior of the enclosure for manually guiding the web, said gauntlets being fitted in orifices in the wall of the enclosure and being provided with gaskets which are capable of applying a counter-pressure while the enclosure is being pressurised.

7. Apparatus as claimed in claim 1 including a pair of drive rolls in the enclosure for the web, said guide rolls being positioned on an ascending portion of the path of travel of the web after it has been longitudinally folded, and upstream of a point where the web, in the form of a tube, has been opened up.

8. Apparatus as claimed in claim 7, including a second pair of rollers in the enclosure for moving the web, said second pair of rollers being positioned downstream of the above-mentioned pair of drive rollers on a descending portion of the path of travel of the web and forwardly of said point where the web, in tube form, is opened up.

9. Apparatus as claimed in claim 8, in which said second pair of rollers for moving the web are provided with manually operated means for guiding the web when said web is being placed in the enclosure.

10. Apparatus for producing in a continuous manner a sterilized product packaged in a sterilized container formed from a continuous web of sealable material comprising, a. a pressure resistant enclosure, b. a web inlet means and container outlet means carried by said enclosure and having a first condition for forming a slidable seal about said web as said web passes through said web inlet and about said container as said container passes through said container outlet, and a second condition for selectively sealing said inlet and said outlet, c. a sterilizing liquid inlet port and discharge port carried by said enclosure to allow a super-heated liquid to enter and sterilize an interior of said enclosure upon said web inlet and said container outlet means being in said second condition, said inlet port carried at an opposite end of said enclosure from said discharge port to allow said liquid to circulate therebetween and cause effective sterilization of said enclosure interior, d. a web sterilizing means carried within said enclosure and including a U-shaped receptacle containing a sterilizing bath, a first set of directional rollers to guide said web from said web inlet through said sterilizing bath in said receptacle, a rotatively carried drum having interior heating means to heat an exterior surface of said drum for causing evaporation of said bath material and further sterilizing of said web on contact, and a second set of directional rollers to cause said web to contact a substantial portion of said exterior surface of said drum and be dried and further sterilized thereby, said second set of rollers carried adjacent to said drum and below said web sterilizing means, e. a third set of directional rollers carried within said enclosure and horizontally spaced from said second set, said third set positioned to rotate said web 90° as said web passes therethrough, f. folding means carried within said enclosure to cause longitudinal edges of said web to be folded to form a 180° angle about the longitudinal center line of said web, said means including a vertically positioned hollow passage having a bottom inlet end positioned above said third set of rollers, a first set of folding rollers to partially fold said web, located in a middle portion of said passage and a second set of folding rollers located at a top outlet end of said passage to complete said 180° fold, said second set of folding rollers comprising one roller rotatively carried in part eccentrically for selective regulation of said roller, g. drive roller means comprising a pair of drive rollers carried within said enclosure and horizontally spaced from said outlet of said folding passage and including one of said rollers carried in part eccentrical for selective regulation of said roller, h. product filling and web sealing means carried within said enclosure for placing said sterilized product within said package and concurrently sealing said longitudinally folded edges of said web, said product filling means being the same as said sterilizing liquid inlet port and said means including a hollow vertical passage having a top inlet located below said drive roller means and a bottom outlet carrying said container outlet means.

* * * * *

UNITED STATES PATENT AND TRADEMARK OFFICE

CERTIFICATE OF CORRECTION

PATENT NO. : 4,045,943

DATED : September 6, 1977

INVENTOR(S) : Herbert Baumstingl

It is certified that error appears in the above-identified patent and that said Letters Patent are hereby corrected as shown below:

[75] Inventor: Herbert Baumstingl,
Tremelo, Belgium

[73] Assignee: Papeteries de Belgique
Bruxelles, Belgium

Signed and Sealed this

*Twenty-second* Day of *January 1980*

[SEAL]

*Attest:*

SIDNEY A. DIAMOND

*Attesting Officer*

*Commissioner of Patents and Trademarks*